United States Patent [19]

Carter

[11] Patent Number: 5,074,796

[45] Date of Patent: Dec. 24, 1991

[54] STACKING AND ORIENTATION INDEPENDENT ELECTRICAL CONNECTOR

[75] Inventor: Andrew L. Carter, Saratoga, Calif.

[73] Assignee: Apple Computer, Inc., Cupertino, Calif.

[21] Appl. No.: 612,336

[22] Filed: Nov. 7, 1990

[51] Int. Cl.[5] ..... H01R 39/02

[52] U.S. Cl. ..... 439/24; 439/21

[58] Field of Search ..... 439/13, 48, 20, 21, 439/23, 24, 28, 38, 39, 668–670, 316, 680

[56] References Cited

U.S. PATENT DOCUMENTS

| | | | |
|---|---|---|---|
| 2,434,534 | 1/1948 | Alford | 439/668 X |
| 3,497,866 | 2/1970 | Patton | 439/680 |
| 4,803,728 | 2/1989 | Lueken | 439/669 X |

*Primary Examiner*—Eugene F. Desmond

*Attorney, Agent, or Firm*—Mark Aaker

[57] ABSTRACT

A stacking and orientation independent multiple contact plug and socket electrical connector has a central connector body with a "plug" extending outward on one face, and a "socket" recessed inward on an opposite face. The plug and socket are aligned along a common axis, but are on opposite faces of the central connector body. The plug is an electrically insulated post extending outward from the central connector body and having multiple electrically conductive circular contact rings encircling the post. The socket is a cylindrical recess into the central connector body designed to accept the plug of another similar connector. The socket has multiple electrical wiper contacts spaced along an electrically insulating inner wall of the recess for contacting to the circular contact rings of a post.

11 Claims, 5 Drawing Sheets

FIG. 5A
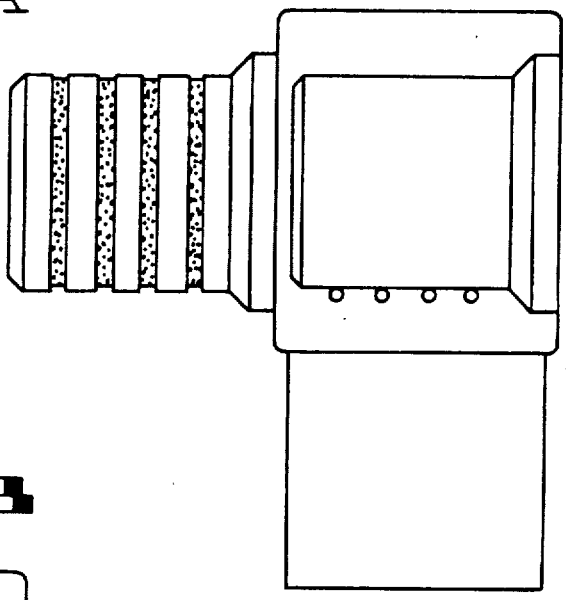
FIG. 5B
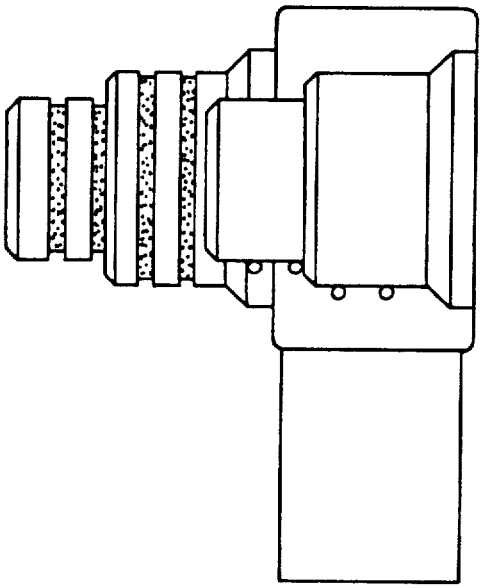
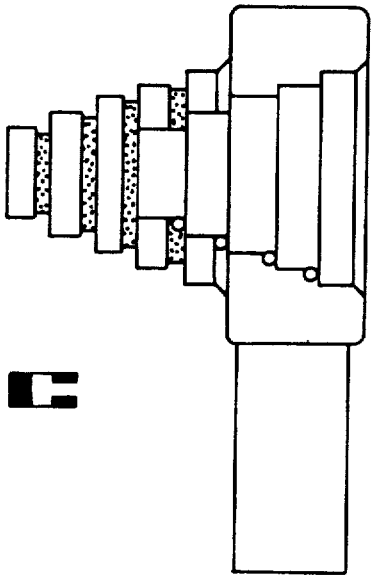
FIG. 5C

STACKING AND ORIENTATION INDEPENDENT ELECTRICAL CONNECTOR

BACKGROUND OF THE INVENTION

This invention relates to electrical connectors, particularly to a stacking and orientation independent plug and socket electrical connector.

A "stacking" electrical connector combines a plug and a socket in one integral unit. When the integral plug is coupled to an external socket, the integral socket is still available to receive another external plug. This allows several stacking connectors to be joined at a single socket location.

An "orientation independent" electrical connector does not require a particular angular orientation of the plug and socket around the axis of insertion of the plug into the socket. In various embodiments, this allows the plug to be inserted without first aligning it to a particular angular orientation, allows the selection of a final angular position of the plug and socket to provide convenient exit of the cable away from the plug and socket, or in a "swiveling" or "rotatable" form allows rotation of the plug through an angle around the axis of plug insertion without loss of electrical contact with the socket.

The stacking feature has been available in some forms of the common "banana" plug. The stacking feature is also available in the large stacking connectors used for connecting devices communicating via the General Purpose Interface Bus (GPIB) or IEEE Standard 488 specifications. This is a 24-conductor cable with a plug and a socket mounted back-to-back in a housing and connected together, with a cable exiting at a fixed angle perpendicular to the axis of connector mating. However, these connectors are not orientation independent.

The orientation independent or "swiveling" feature has been available in the common stereo headphone plug and jack, a descendent of the telephone jack. However, these connectors are limited to a small number of electrical contacts or circuits, and do not include the stacking feature.

The stacking and orientation independent features have not been previously been combined in a single multiple contact plug and socket electrical connector. Such a connector would provide the advantages of each feature as mentioned above, and provide a connector of great value for connecting to a device where the panel space for connectors is limited but where a large number of cables need to be connected to the device.

SUMMARY OF THE INVENTION

This invention provides a stacking and orientation independent multiple contact plug and socket electrical connector.

A connector in accordance with this invention has a central connector body with a "plug" extending outward on one face, and a "socket" recessed inward on an opposite face. The plug and socket are aligned along a common axis, but on opposite faces of the central connector body.

In a first embodiment, the plug is an electrically insulated cylindrical post extending outward from the central connector body and having multiple electrically conductive circular contact rings encircling the post.

In the same first embodiment, the socket is a cylindrical recess into the central connector body designed to accept the cylindrical post plug of another same connector. The socket has multiple electrical wiper contacts spaced along an electrically insulating inner wall of the recess for contacting to the circular contact rings of a cylindrical post plug.

In other embodiments, the plug is a stepped or multiply-stepped cylinder, similar to a tiered "wedding cake." A corresponding socket has multiple stepped-diameter cylindrical recesses with electrical wiper contacts.

In various embodiments, orientation independence of the plug and socket is controlled through a detent ring or capture probe and matching capture probe recess.

A cable can leave the connector body transverse to the axis of the plug and socket. The connector can have a termination housing between the connector body and cable to contain electronic components to interface the conductors of the cable to the conductors of the plug and socket.

BRIEF DESCRIPTION OF THE DRAWINGS

FIGS. 5A-5C illustrate three different embodiments of a stacking and orientation independent plug and socket connector in accordance with this invention.

DETAILED DESCRIPTION

Figure 1:
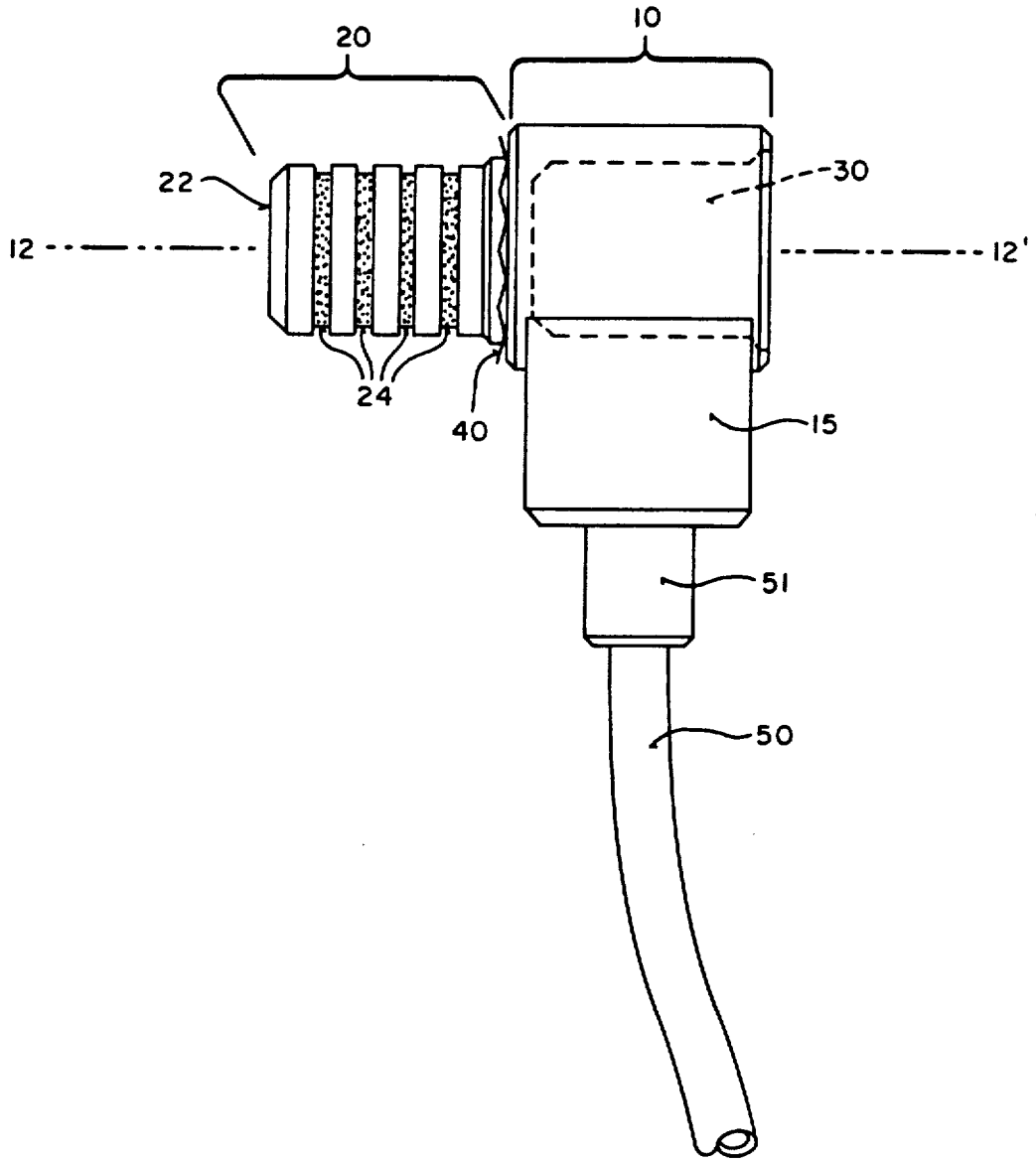
FIG. 1 is a side view of a stacking and orientation independent plug and socket connector in accordance with this invention.

FIG. 1 is a side view of a stacking and orientation independent plug and socket connector in accordance with this invention. In this first embodiment, the connector has a central connector body 10. On a first face of the central connector body 10 is a plug 20 extending outward. The extension of the plug 20 from the first face of the central connector body 10 defines an axis 12—12' extending through the plug 20, through the first face of the central connector body 10, through the central connector body 10, and exiting on an opposite second face of the central connector body 10. Aligned along and around the axis 12—12' and recessed inward from the second face and extending into the central connector body 10 is a socket 30.

In the embodiment of FIG. 1, plug 20 is an electrically insulated cylindrical post 22 having multiple electrically conductive circular contact rings 24 encircling the post 22 and longitudinally spaced along the length of the post 22. The post can be molded of a hard plastic. The rings 24 can be of conductive metal and can be slightly above, flush, or slightly recessed below the surface of post 22. This plug can be inserted into a socket on a piece of equipment, or inserted into the socket 30 of a similar plug and socket connector.

The shape of post 22 and the placement of the circular contact rings 24 can be used to establish separately sized or polarized plugs. For example, where the stacking feature of these connectors is used to form an extended "branching tree" bus for the distribution of signals from a controlling source, it may be desirable to distinguish "downstream" connections (away from the source) from "upstream" connections (toward the source), which can be done by separately shaped connectors. Similarly, the post 22 can have a longitudinal groove or alignment "key" to control its angular orientation during coupling to a socket 30.

The circular contact rings 24 can fully or partially encircle the post 22. It is preferred that the contact rings are recessed below the surface of the post 22 so that they will not contact a conductive surface if the connector is set upon a metal surface or table.

Socket 30 is a cylindrical recess into central connector body 10 designed to receive a plug such as plug 20. The socket 30 has multiple electrical wiper contacts spaced along an insulating inner wall of the socket recess for contacting to the circular contact rings 24 of a post 22. In a preferred form, each circular contact ring 24 of the plug 20 is connected to a corresponding wiper contact in the socket. This allows stacking of connectors and the extending of the electrical connections to additional "stacked" connectors.

In a preferred form, the plug 20 and socket 30 can swivel in relation to one another during and after coupling. A detent ring 40 can be provide control of the swivel action, mechanical spring tension between the plug 20 and socket 30, and a ground or shield ring around the coupled plug 20 and socket 30. In a preferred form shown in FIG. 1, detent ring 40 is a compressible, spring-like, wavy, electrically conductive washer that encircles the base of the post 22, and is at least partially in contact with the first face of central connector body 10 from which the post 22 extends outward. The detent ring 40 has multiple raised portions extending above the face of the central connector body 10 from which the post 22 extends outward, these raised portions adapted to limit the number of swiveling positions of plug 20 to a number of fixed detent positions related to the position of the raised portions on the detent ring 40. Application of a rotational torque can cause the connector to overcome the tension of detent ring 40 and rotate to a new detent position. The torque required should be high enough such that the weight of an exiting cable is insufficient to cause rotation. The detent ring 40 also provides a spring tension between the plug 20 and a socket 30 when coupled to prevent loose movement, rattling, and intermittent electrical contact or "contact noise". The detent ring 40 can also serve as a ground or shield connection completing the electrical enclosure of the plug 20 and socket 30 when coupled, to prevent electrical signals from radiating in or out of the coupled plug and socket.

In a preferred form shown in FIG. 1, a cable 50 leaves the connector transverse to the axial alignment 12—12' of the plug 20 and socket 30. Between the cable 50 and central connector body 10 is a termination housing 15 attached to central connector body 10 to contain electrical components to couple the electrical contacts of the plug 20 and socket 30 to the conductors of cable 50. The point at which the cable 50 leaves the termination housing 15 can be supplemented by a strain relief 51. The cable 50 could have another plug and socket connector on the other end of the cable.

Figure 2:
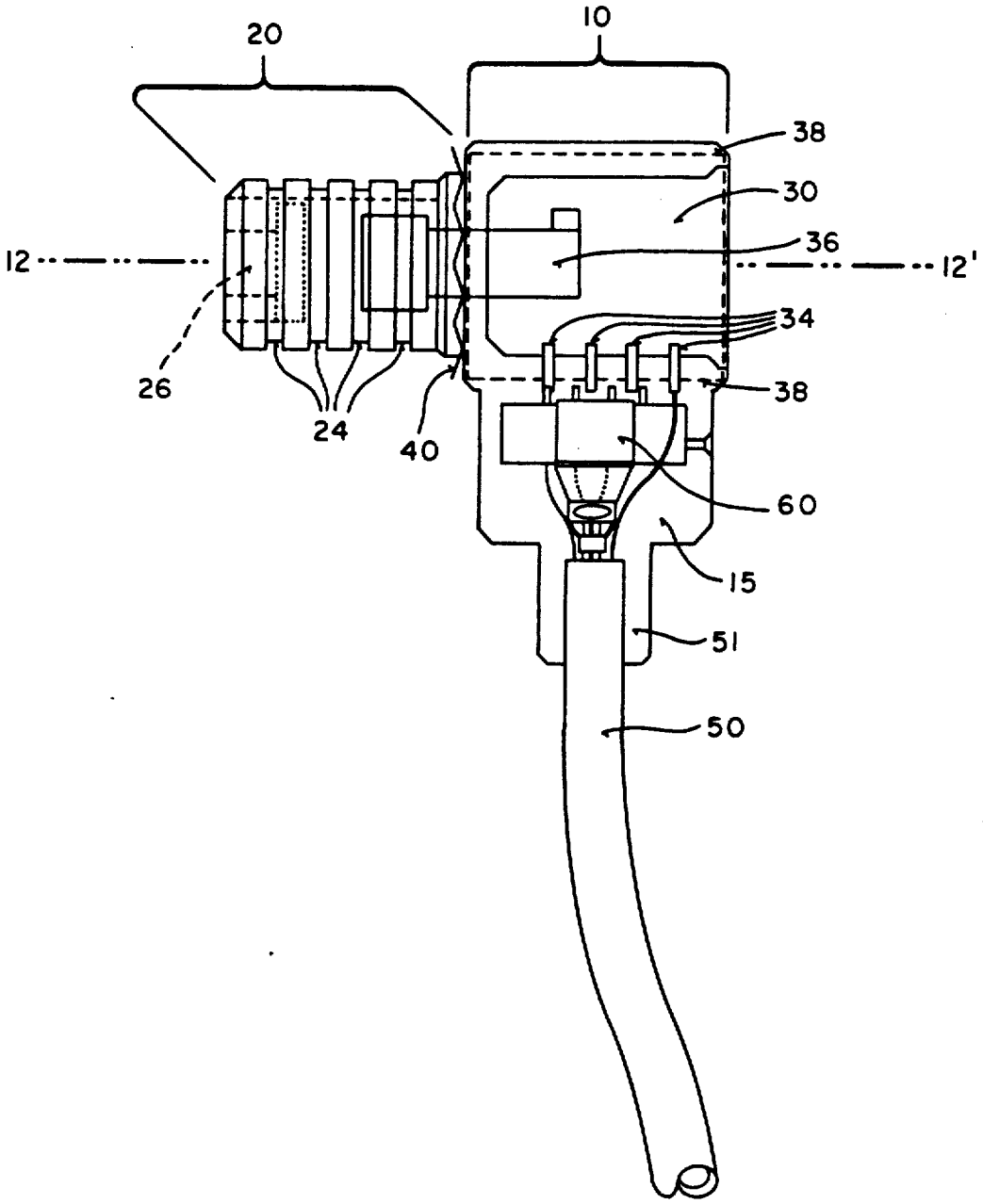
FIG. 2 is a simplified cut-away side view which shows more internal detail of the connector of FIG. 1.

FIG. 2 is a simplified cut-away side view which shows more internal detail of the connector of FIG. 1. The same numbering is used for elements which were previously shown in FIG. 1.

Newly shown in FIG. 2 are multiple electrical wiper contacts 34 longitudinally spaced along the insulating inner wall of socket 30 for contacting to the circular contact rings 24 of an inserted plug 20. These wiper contacts 34 can be cantilever or bellows-style contacts in a row along the "bottom" of the socket cavity, or spaced at various distances and angles around the inner wall of socket recess 30. It is preferred that they be designed for a high normal-force to the mating circular contact rings 24 of the plug 20, such that a tin plating can be used on the wiper contacts 34 for reduced cost. The length of the wiper contacts 34 should be minimized to reduce the likelihood of electromagnetic radiation out of the socket 30 when a plug 20 is not mated to it.

In a preferred form, and shown in FIG. 2, the socket 30 can be surrounded by a metal shield 38 either within or around central connector body 10. The shield 38 has an exposed contact area surrounding the socket opening such that the detent spring 40 of a mating plug 20 may bear upon it for electrical grounding and shielding, mechanical tension, and detent control of swiveling. The shield 38 and inner wall of socket 30 have openings where required for the socket contacts 34 and other intruding elements. The shield 38 can be covered with a cosmetic molded plastic insulating cover.

Also shown in FIG. 2 is a capture probe 36 projecting axially within the socket 30. The capture probe is designed for coupling to a capture probe recess 26 formed axially in the tip or outward face of the post 22 of a plug 20. In a mating plug 20 and socket 30, the capture probe 36 and capture probe recess 26 interact like a "key" coupling to a matching "keyway."

The capture probe 36 and matching capture probe recess 26 serve several functions. First, when coupled they can serve to lock the plug 20 and socket 30 into closer, stronger contact, to improve the mechanical and electrical contact between the plug 20 and socket 30. Second, they can serve to assist in the alignment and coupling process by guiding the plug 20 and socket 30 into correct alignment as they are coupled. Third, they can control the degree of rotation allowed during and after coupling. For example, initial insertion of the plug 20 and socket 30 can be allowed in any angular position, or can be restricted to one or a few specific angular positions. Further, when fully coupled, rotation between the plug 20 and socket 30 can be allowed or prevented, or only allowed over specific ranges, depending on the interlocking shapes of the capture probe 36 and capture probe recess 26.

Another function that can be served by requiring the plug to be rotated during coupling is to insure that connections between the circular contact rings 24 and wiper contacts 34 occur in a specific sequence, such as completing a ground connection first and a power connection last. This can be achieved by leaving small gaps in the circular contact rings 24, for example along a longitudinal groove on the top of the post 22. The keyway of the capture probe 36 and capture probe recess 26 can require this gap to be positioned over the wiper contacts during coupling, preventing any electrical contact, Then, after coupling the plug is rotated to engage the capture probe 36 and capture probe recess 26, and the rings come into contact with the wiper contacts during the rotation in an sequence depending on the width of the gaps in the rings and the positioning of the wiper contacts. For example, when each contact ring 24 is set back from the groove (on both sides) by a slightly different distance, such that when the plug is rotated (in either direction) to capture it in a socket, that the contacts pairs mate in a specific sequence.

For example, illustrated in FIG. 2, the capture probe 36 is a small diameter cylindrical projection inside the socket cavity, with a transverse bump on the end. The bump slides down a keyway in the hollow bore of a capture probe recess 26 in a mating plug 20. When the mating connector is rotated from the insertion orientation (which can occur only when the connector is properly seated,) the bump engages an annular groove of larger diameter than the bore, thus causing the mating plug 20 to be captured. This action also causes the mating plug 20 to be drawn somewhat closer, compressing the detent ring 40.

It should be noted that the shapes of capture probe 36 and capture probe recess 26 can be used to separate connectors of different electrical polarization, signal types, or other differentiations. Due to the forces involved in its functioning, the capture probe 36 should be made of a very strong material, such as a cold-headed steel part for insert molding into the connector.

Also shown in FIG. 2 are electrical components 60 within termination housing 15 attached to central connector body 10. These components connect from the conductors of cable 50 to the wiper contacts 34 and shield 38. These components can interface between the electrical characteristics of the conductors of cable 50, and those of the conductors of the plug 20 and socket 30. For example, in a preferred form, cable 50 holds fiber optic cables, and electrical components 60 complete an optical to electrical interface for connection to the electrical conductors of plug 20 and socket 30. Of course other types of analog and digital conversion, amplification, and other electrical functions can be performed by components 60. The cable 50 can hold both fiber optic and electrical conductors.

Figure 3:
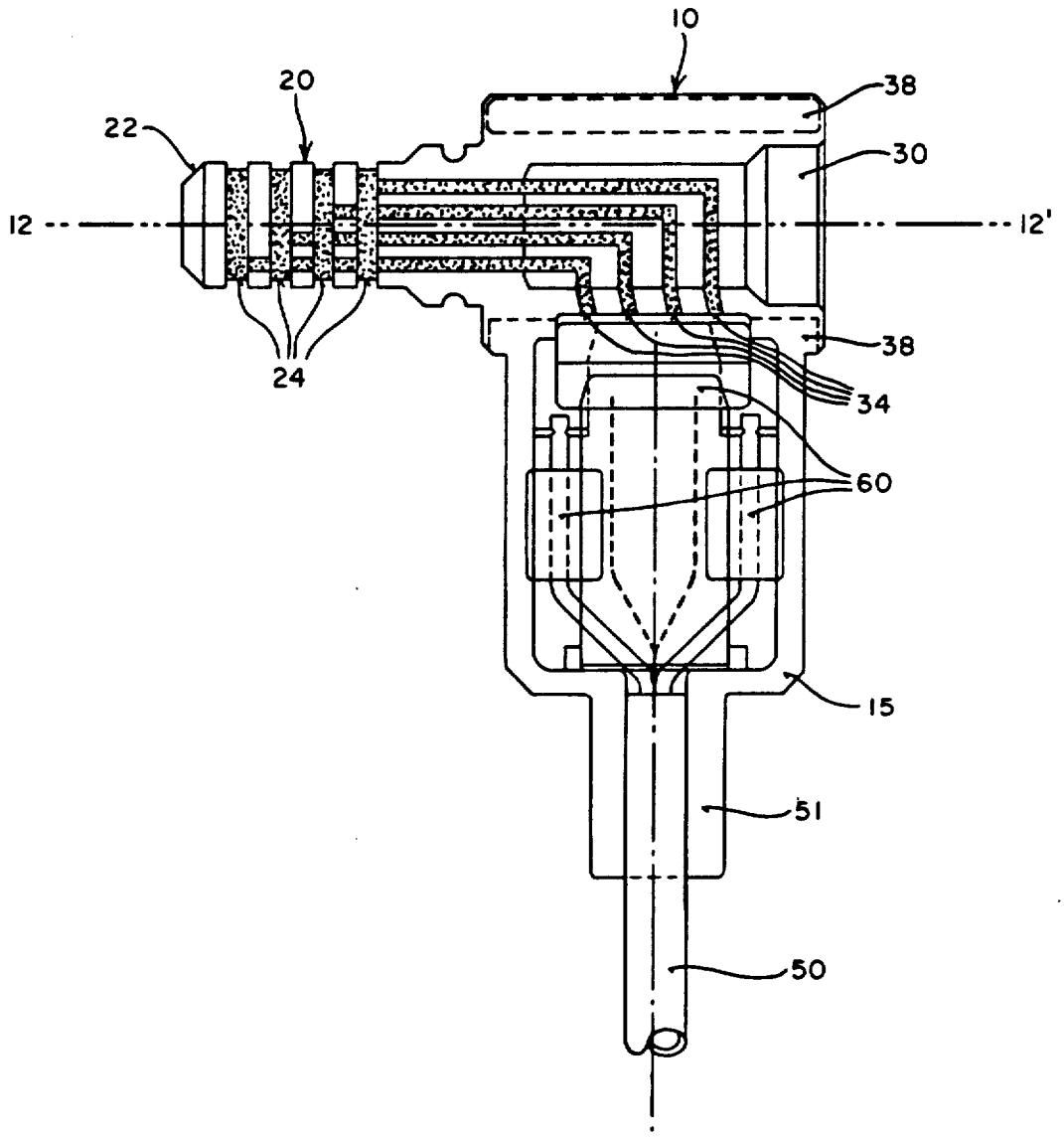
FIG. 3 is a simplified cut-away side view which shows the electrical connections to the circular contact rings and electrical wiper contacts of a stacking and orientation independent plug and socket connector in accordance with this invention.

FIG. 3 is a simplified cut-away side view which shows the electrical connections to the circular contact rings and electrical wiper contacts of a stacking and orientation independent plug and socket connector in accordance with this invention. The same numbering is used for elements which were previously shown in FIG. 1 or FIG. 2. The embodiment of FIG. 3 does not show the features of the capture probe 36 and matching capture probe recess 26. In particular, FIG. 3 shows how each circular contact ring 24 of plug 20 is connected to a corresponding wiper contact 34 of the socket 30. These connections are run from the circular contact rings 24 within post 22, down post 22 toward socket 30, and around socket 30 within central connector body 10 to connect to the wiper contacts 34. Of course, connection can also be made to the electrical components 60 and the shield 38 depending on the particular electrical configuration desired. Thus, a 4-conductor bus with a large number of extending connections can be created. In FIG. 3, the electrical components 60 within termination housing 15 are located in several separate packages as might occur where there are separate transmitting and receiving components for connection to the conductors of cable 50.

Figure 4:
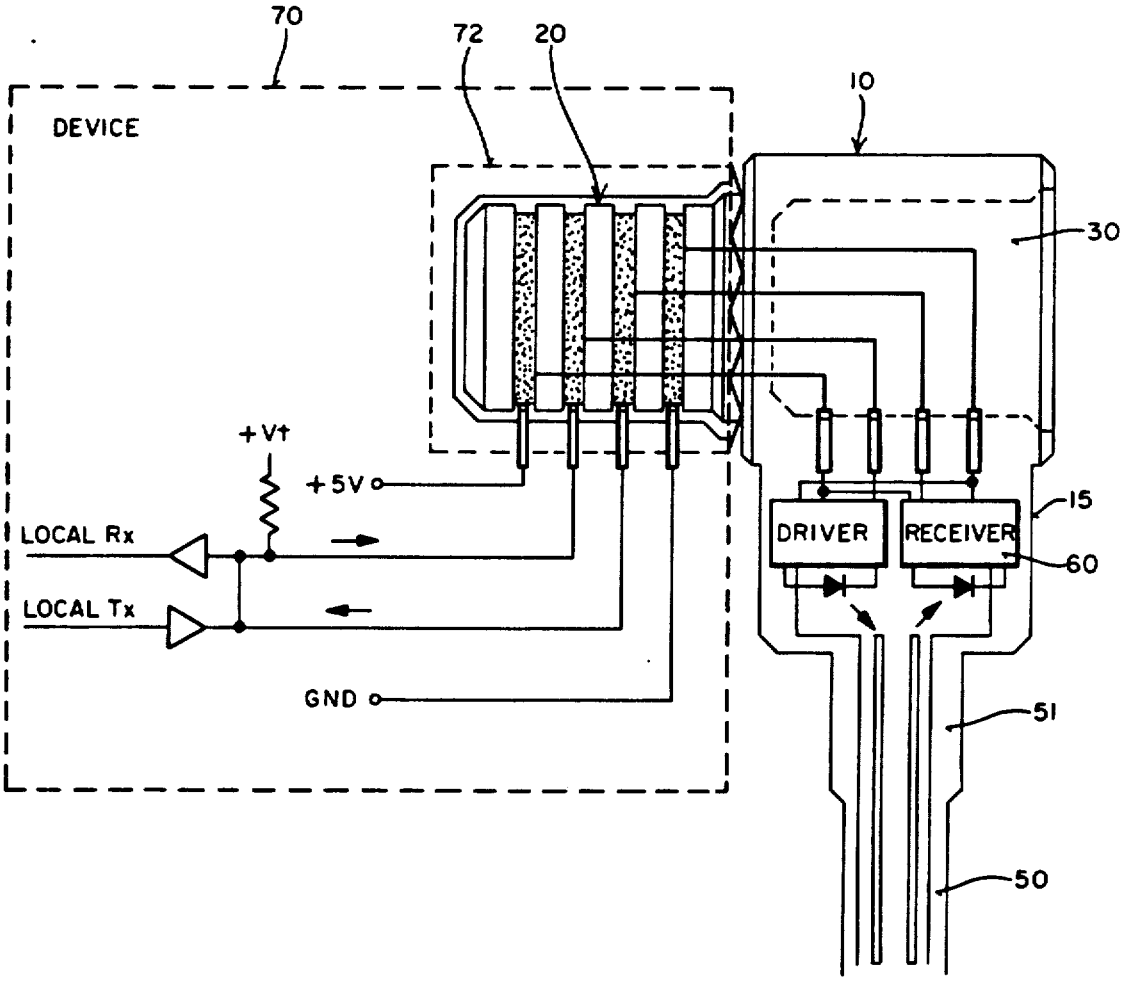
FIG. 4 is an illustration of the electrical connections of a stacking and orientation independent plug and socket connector in accordance with this invention.

FIG. 4 is an illustration of the electrical connections of a stacking and orientation independent plug and socket connector in accordance with this invention. The same numbering is used for elements which were previously shown in FIGS. 1, 2 or 3. In the embodiment shown in FIG. 4, the connector's termination housing 15 contains active signal electronics. FIG. 4 shows how signals from a device 70 such as a computer, are transferred through a device socket 72 to a plug 20 of a plug and socket electrical connector in accordance with this invention. In the connector, the signals are connected to the socket 30 to be available to reach further stacked connectors, and also to the electrical components 60 for coupling to the conductors of cable 50.

An electrical connection system such as shown in FIG. 4 and using the connectors of this invention can transmit up to a 40 million bits per second digital signal between computers and their peripheral devices. A stack of up to four connectors can be used. Both electrical and fiber optic versions of cable 50 can be used. Both power, ground, and two directions of signals can be carried through cable 50.

FIG. 5 is an illustration of three different embodiments of a stacking and orientation independent plug and socket connector in accordance with this invention. FIG. 5A shows the embodiment as already described for FIGS. 1-4. FIG. 5B shows an embodiment in which the plug is comprised of two "stacked" cylinders of different diameters. Similarly, the matching socket has recesses of two sizes for receiving such stacked cylinders. FIG. 5C shows an embodiment in which the plug has multiple stacked cylinders, with a contact ring per cylinder. Similarly, the socket has recesses of multiple sizes for receiving such stacked cylinders. These alternative embodiments of FIGS. 5B and 5C reduce the overall length of the connector, and reduce its total projection above a socket in a device panel, especially when several connectors are stacked. Also, the connector may be less fragile. However, these embodiments impose additional manufacturing and assembly requirements over the embodiment of FIG. 5A.

In other embodiments, mechanical latching mechanisms may be used to couple connectors to each other or to a panel-mounted socket. These and other embodiments of the invention will be apparent to one skilled in the art from a consideration of the specification, drawings and claims. It is intended that the scope of the invention be limited only by the scope of the following claims.

I claim:

1. A stacking and orientation independent plug and socket electrical connector comprising:

a central connector body having at least first and second faces parallel and on opposite ends of said central connector body;

a plug extending outward from said first face on said central connector body, said plug extending outward in a direction defining an axis through said plug and said central connector body;

a socket recessed inward from said second face and extending into said central connector body, said socket recess aligned on said axis, and longitudinally spaced along said axis from said plug;

a cable leaving said central connector body transverse to the axial alignment of said plug and socket;

said plug comprising an electrically insulating material formed as a cylindrical post symmetric about said axis and having multiple electrically conductive circular contact rings encircling and longitudinally spaced along said cylindrical post; and said socket having multiple electrical wiper contacts longitudinally spaced along an inner wall of said socket recess for contacting to said circular contact rings of an inserted said plug.

2. A connector as in claim 1 wherein said cylindrical post is formed as a stepped cylinder having a first cylindrical portion closest to said first face of said central connector body having a relatively larger diameter than a second cylindrical portion further from said first face of said central connector body.

3. A connector as in claim 1 wherein said cylindrical post is formed as a multiply-stepped cylinder having multiple cylindrical portions of decreasing diameters located respectively further from said first face of said central connector body.

4. A connector as in claim 1 further comprising there being at least four said circular contact rings electrically connected within said central connector body to corresponding four said wiper contacts.

5. A connector as in claim 1 wherein said central connector body contains electrical components for interfacing said plug and said socket to conductors within said cable.

6. A connector as in claim 1 further comprising a detent ring encircling the base of said plug at least partially in contact with said first face of said central connector body from which said plug extends outward.

7. A connector as in claim 6 wherein said detent ring has multiple raised portions extending above the face of said central connector body from which said plug extends outward, said raised portions adapted for control of swiveling of said plug to a number of detent positions related to the position of said raised portions on said detent ring.

8. A connector as in claim 1 further comprising a capture probe projecting from the base of said socket recess inside said central connector body along said axis into said socket.

9. A connector as in claim 8 further comprising a capture probe recess formed in the outward face of said plug and extending along said axis into said plug for receiving a said capture probe when a said plug and said socket are coupled.

10. A connector as in claim 9 wherein said capture probe and said capture probe recess are formed in complementary keyed shapes which limit the span of rotation of said plug relative to a said socket after said plug is fully inserted into a said socket.

11. A connector as in claim 9 wherein said capture probe and said capture probe recess are formed in complementary keyed shapes which allow rotation of the plug and socket as said plug is inserted into a said socket, but locks them in a fixed orientation as full insertion is reached.

* * * * *